US008851743B1

(12) United States Patent
Lalo

(10) Patent No.: US 8,851,743 B1
(45) Date of Patent: Oct. 7, 2014

(54) TRIGGER MECHANISM FOR A CHRONOGRAPH WATCH

(75) Inventor: Eyal Lalo, Hallandale, FL (US)

(73) Assignee: Invicta Watch Company of America, Inc., Hollywood, CA (US)

( * ) Notice: Subject to any disclaimer, the term of this patent is extended or adjusted under 35 U.S.C. 154(b) by 467 days.

(21) Appl. No.: 13/215,871

(22) Filed: Aug. 23, 2011

(51) Int. Cl.
*G04F 7/08* (2006.01)

(52) U.S. Cl.
USPC ..... 368/315

(58) Field of Classification Search
USPC ..... 368/185, 190, 288–290, 308, 315, 368/319–321
See application file for complete search history.

(56) References Cited

U.S. PATENT DOCUMENTS

| | | | | |
|---|---|---|---|---|
| 3,759,033 | A | 9/1973 | Jeanmonod | |
| 4,364,674 | A | 12/1982 | Tesch | |
| 5,224,077 | A | 6/1993 | O'Brien | |
| 6,203,189 | B1 * | 3/2001 | Schafer | 368/320 |
| 6,210,034 | B1 * | 4/2001 | Latini | 368/289 |
| 6,227,700 | B1 * | 5/2001 | Hunziker et al. | 368/321 |
| 6,247,841 | B1 * | 6/2001 | Erard | 368/308 |
| 6,846,998 | B2 * | 1/2005 | Hasumi et al. | 200/341 |
| 7,570,545 | B2 | 8/2009 | Journe | |
| 2010/0061194 | A1 * | 3/2010 | Hobor | 368/216 |
| 2011/0002198 | A1 * | 1/2011 | Wyssbrod | 368/287 |

* cited by examiner

*Primary Examiner* — Amy Cohen Johnson
*Assistant Examiner* — Jason Collins
(74) *Attorney, Agent, or Firm* — Howard Natter; Natter & Natter

(57) ABSTRACT

A trigger mechanism for remotely operating the chronograph functions of a watch. A lever mounted to the watchcase is swingable about a pivotal connection for rotating a cylindrical cam. A rotary cam follower is displaced by the cam. A striker member extending from the cam follower actuates a pushbutton for controlling the chronograph functions.

12 Claims, 3 Drawing Sheets

TRIGGER MECHANISM FOR A CHRONOGRAPH WATCH

REFERENCE TO RELATED APPLICATION

This application is related to a design patent application (Ser. No. 29/390,683) filed Apr. 28, 2011, now U.S. Design Pat. No. D646,588 and is incorporated herein by reference.

BACKGROUND OF THE INVENTION

1. Field of the Invention

This invention relates to horology and especially to watches having stop/start and/or reset functions.

In particular, this invention concerns a trigger mechanism for mechanically actuating the chronograph functions of a watch.

2. Description of Related Art

Chronograph watches typically include one or more pushbuttons, pushers, depressors, pressure switches, or equivalent devices, mounted for movement relative to a watchcase within which is housed a watch movement including one or more elements that are adapted to be actuated by the operation of the one or more pushbuttons, for example, as shown in U.S. Pat. No. 4,364,674 and U.S. published application no. US2006/0164922. This arrangement is generally found in both mechanical and electronic watches for operating the various functions, such as the stop/start systems in stopwatches and the time display systems in electronic watches.

The pushbuttons are typically actuated manually by finger manipulation. This procedure does not readily achieve precision timing as may be needed for sporting events and similar activities. In manually operated chronographs the flesh surrounding the finger-tip cushions the actuation of the pushbutton and may cause variations in timing precision. Also, gloves covering the finger tip, can create timing imprecision.

An attempt to enhance stopwatch precision is shown in U.S. Pat. No. 5,224,077, however, the device of that patent is not an integral part of the watchcase and is cumbersome to use.

Another timepiece, shown in U.S. Pat. No. 3,759,033, is intended to actuate a pushbutton by use of a pivotal key. That device however, does not apply mechanical linkage for transforming the movement of the key into a reciprocal movement for actuating the pushbutton for improved precision as in the present invention.

A further device for operating a chronograph is disclosed in U.S. Pat. No. 7,570,545. The rocker mechanism of that device lacks the precision control achievable with the present invention.

SUMMARY OF THE INVENTION

Briefly, this invention concerns a trigger mechanism for operating a chronograph watch having a watchcase with a switch member for controlling the chronograph functions comprising, a striker member for remotely actuating the switch, a lever having a pivotal connection to the watchcase for swingable movement about the pivotal connection, mechanical linkage for transforming said pivotal movement of the lever to reciprocal movement of the striker member between a rest position and a stroke position with said switch member being actuated when the striker member is in the stroke position.

Having thus summarized the invention, it will be seen that it is a preferred object thereof to provide a trigger mechanism for a chronograph watch of the general character described herein which is not subject to the previously mentioned limitations.

Another preferred object of this invention is to provide a trigger mechanism for a chronograph watch for remote actuation of the pushbutton.

Yet still another preferred object of this invention is to provide a trigger mechanism for a chronograph watch wherein a mechanical force is generated and selectively applied on the pushbutton for improved precision of operation.

A further preferred object of this invention is to provide a trigger mechanism for a chronograph watch wherein the pushbutton actuation is mechanically linked to a pivotal lever.

With these ends in view, the invention finds embodiment in certain combinations of elements and arrangements of parts by which the aforementioned preferred objects and certain other objects are hereinafter attained, all as more fully described with reference to the accompanying drawings and the scope of which is more particularly pointed out hereinafter.

BRIEF DESCRIPTION OF THE DRAWINGS

In the accompanying drawings, in which is shown an exemplary embodiment of the invention.

DETAILED DESCRIPTION OF THE INVENTION

With specific reference now to the figures in detail, it is stressed that the particulars shown are by way of example and for the purposes of illustrative discussion of the preferred embodiment of the present invention only and are presented in the cause of providing what is believed to be the most useful and readily understood description of the principles and conceptual aspects of the invention. In this regard, no attempt has been made to show aspects of the invention in more detail than is necessary for a fundamental understanding of the invention, the description taken with the drawings should make it apparent to those skilled in the art how the preferred form of the invention may be embodied in practice.

Figure 1:
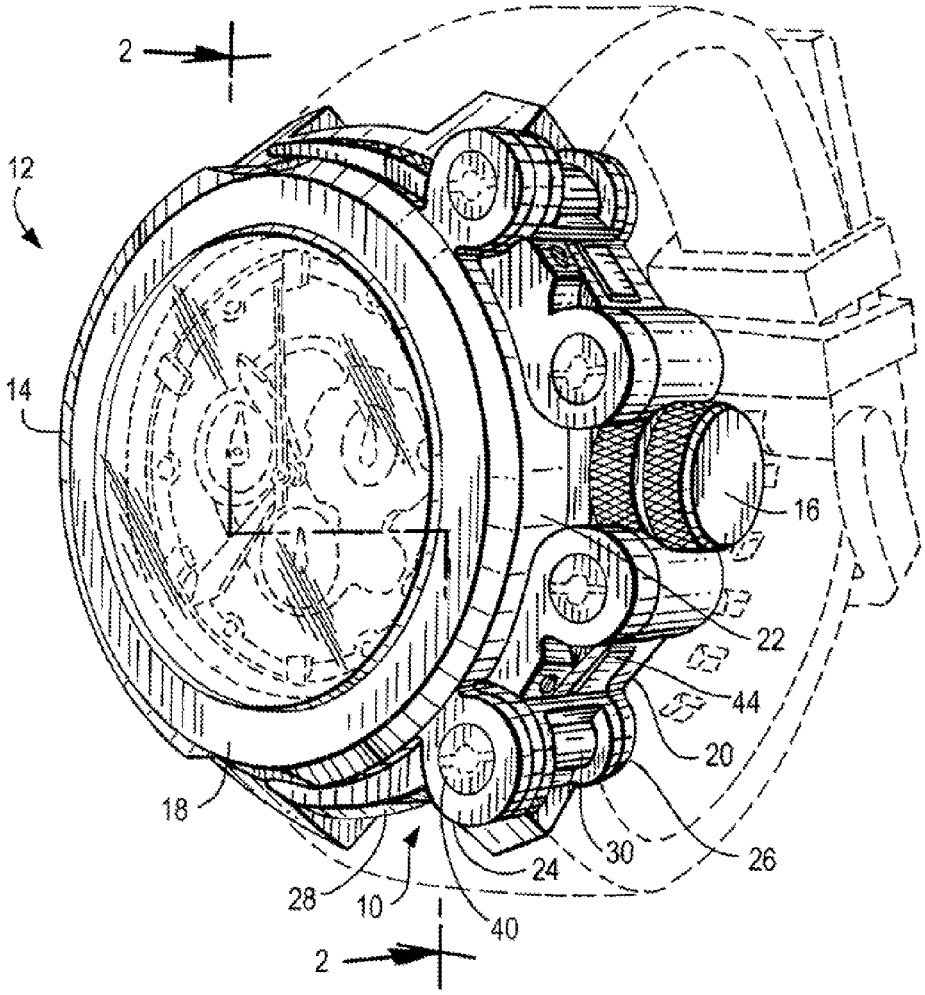
FIG. 1 is a partial perspective view of a watch showing a trigger mechanism in accordance with this invention.

Referring now in detail to FIG. 1 of the drawings, there is shown a trigger mechanism 10 for a chronograph watch 12 of this invention. The trigger mechanism 10 provides for remote operation of the chronograph functions of the watch 12. It should be understood that the watch 12 can be a digital and/or analog chronograph or an analog-digital chronograph. Additionally the trigger mechanism 10 can be utilized with stopwatches that do not have timekeeping functions.

As shown in FIG. 1, the watch 12 has a watchcase 14 for housing a watch movement (not shown) and a crown 16 connected to a watch stem (not shown) extending internally within the watchcase 14. The watchcase 14, further has a front face 18, a rear face 20 and a peripheral sidewall 22.

The trigger mechanism 10, as shown in this embodiment, is positioned on opposite sides of the crown 16. Since the component elements and operation of each trigger mechanism 10 shown is substantially identical, the invention will be described with regard to the trigger mechanism 10 located at the four o'clock position on the watch 12.

Figure 3:
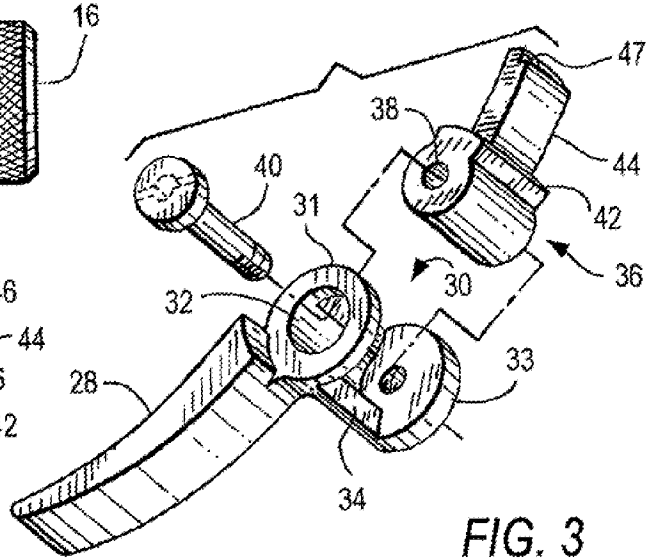
FIG. 3 is an exploded perspective view, to an enlarged scale, detailing a lever having at its distal end a cylindrical cam member and a complementary rotary cam follower.

The sidewall 22 includes an upper aperture disc 24 extending from the front face 18 and a lower aperture disc 26 extending from the rear face 20. A lever 28, as shown in FIG. 3, has an open cylindrical cam member 30 at its distal end. The cam member 30 is defined by a cylindrical wall 32 that extends partially around the periphery and by a respective top end member 31 and bottom end member 33. The end members 31, 33 are adapted to support the cam member 30 between the respective discs 24 and 26.

The wall 32 further defines a cam surface 34. A complimentary rotary cam follower 36 has an axial bore 38, and is accommodatable within the cam member 30. A pivot pin 40 secures the cam follower 36 and cam member 30 to the discs 24, 26 for concentric rotation relative to each other about the pin 40. Further with regard to the cam follower 36, a follower tooth 42 is adapted for abutting contact with the cam surface 34. The cam follower 36 is also provided with a striker member 44 that is registrable with a push-switch, such as pushbutton 46, that controls the chronograph functions of the watch 12. It should be understood that equivalent switch devices are considered to be within the scope of this invention.

Figure 2:
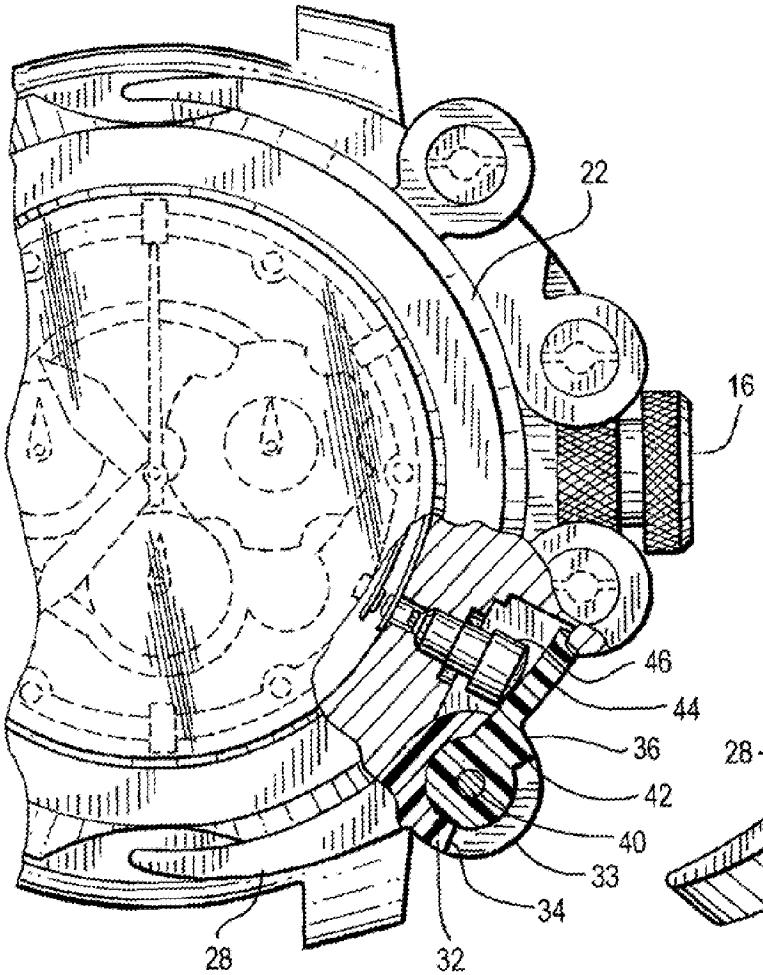
FIG. 2 is a sectional view taken substantially along line 2-2 of FIG. 1, with a portion broken away, for illustrating a spring-urged pushbutton mounted within a watchcase.

Referring now to FIG. 2, there is shown, in partial sectional view, the pushbutton 46 housed within a recess 48 in the sidewall 22 of the watchcase 14. The recess has a window 49 for accommodating the striker member 44. The pushbutton 46 is adapted to be depressed, in opposition to a spring-force, by the striker member 44 to thus actuate the chronograph functions. The Operation of a chronograph is otherwise known in the art. It should be further noted that the pushbutton 46 resiliently urges the striker member 44 to a rest position as shown in FIG. 2. The striker member 44 when under the influence of the resilient urging force, is secured within the window 49 by a notch 47 formed in the end of the striker member 44. The notch 47 engages a lip 50 to retain the striker member 44 within the window 49.

Figure 4:
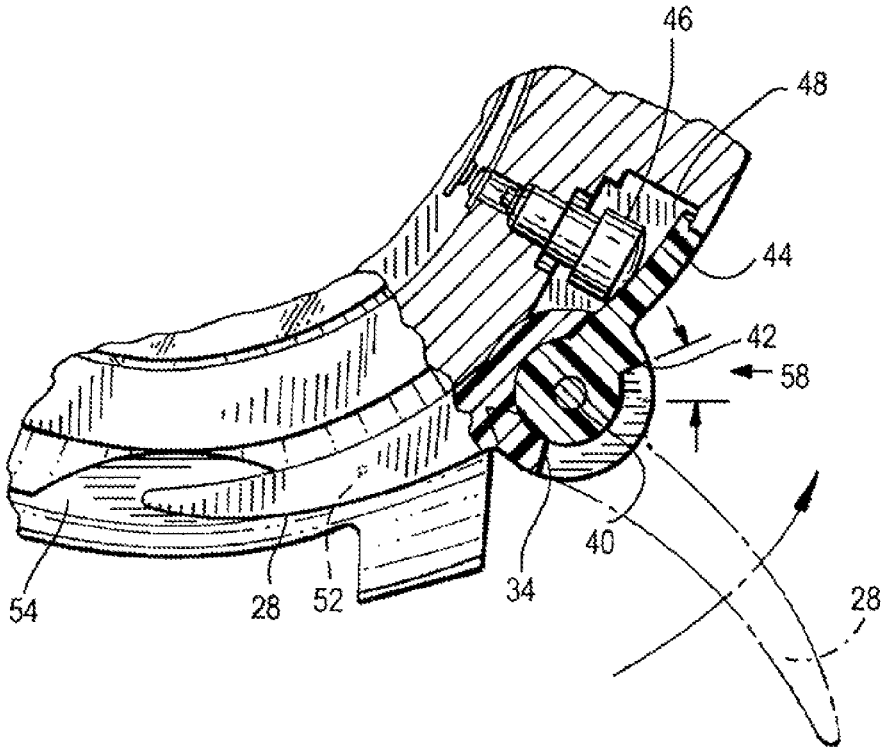
FIG. 4 is a plan view of a portion of the watchcase, with a section broken-away, illustrating, by arrows, rotational movement of the lever and the cam member with respect to the cam follower.
Figure 5:
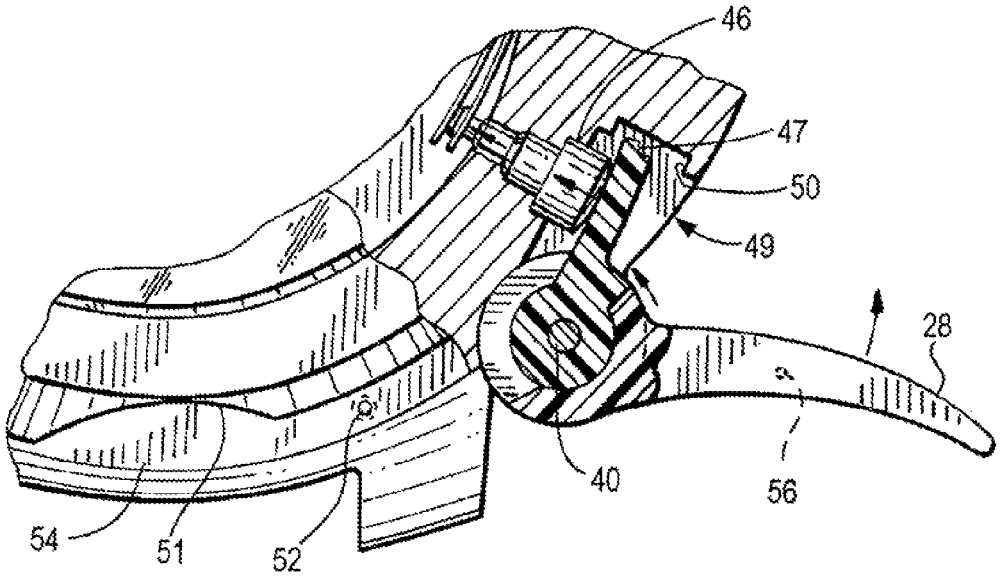
FIG. 5 is a plan view of the watchcase of FIG. 4 showing, by arrows, the rotational displacement of the cam follower having a striker member for engaging the pushbutton to actuate a chronograph function of the watch.

The operation of the trigger mechanism 10 will now be described with particular reference to FIGS. 4 and 5. When it is desired to actuate the chronograph function of the watch 12, a proximal end of the lever 28 is released from a docked position, as shown in FIG. 2, adjacent sidewall 22 of the watchcase 14. Note that the sidewall 22 defines a crescent-shaped depression 51 for permitting fingertip access to the lever 28. Additionally, a spring-loaded ball 52 within a ledge 54 is engageable with a detent 56 in the lever 28 to secure the lever 28 in the docked position. The lever 28 is swingably displaced, as indicated by the arrows in FIG. 4, and the cam surface 34 will approach the cam follower 36. As the lever 28 continues moving, the cam surface 34 will traverse the angular distance 58, to contact the cam follower tooth 42 as shown in FIG. 5. Further movement of the lever 28 will rotate the cam follower 36 and the striker member 44 to a stroke position to contact and exert a force, upon the pushbutton 46, as indicated by the arrows, and to thus actuate the chronograph function. When the lever 28 is then restored to the docked position, the pushbutton 46 will urge the striker member 44 to a reciprocal rest position wherein the lip 50 will secure the striker member 44 in the window 49 as shown in FIG. 4.

It should thus be apparent that the trigger mechanism 10 achieves the various preferred objects of this invention and is well adapted to meet conditions of practical use. Since other various possible embodiments might be made to the present invention or modification might be made to the exemplary embodiment set forth above, it is to be understood that all materials shown and described with reference to the accompanying drawings are to be interpreted as illustrative and not in a limiting sense.

Having thus described the invention, there is claimed as new and desired to be secured by Letters Patent:

1. A trigger mechanism for operating a chronograph watch having a watchcase and a switch member for controlling the chronograph functions of the watch comprising a striker member for remotely actuating the switch member, a lever having a pivotal connection to the watchcase for swingable movement about the pivotal connection, mechanical linkage including a cam member and a cam follower, said mechanical linkage being effective for transforming said swingable movement of the lever to reciprocal movement of the striker member between a rest position and a stroke position, said switch member being actuated when the striker member is in the stroke position, said switch member further including a constraining force for returning the striker member to the rest position.

2. A trigger mechanism as claimed in claim 1 wherein the swingable movement of the lever rotates the cam member into contact with the cam follower for displacing the cam follower.

3. A trigger mechanism as claimed in claim 2 wherein the cam follower includes the striker member, said striker member being registrable with the switch member.

4. A trigger mechanism for remotely operating chronograph functions of a watch comprising a watchcase having at least one switch member for controlling the chronograph functions of the watch, a lever having a hinged connection to the watchcase, the hinged connection including a cylindrical cam member, a rotary cam follower for cooperative interaction with the cam member, said cam follower including a striker member registrable with the switch member, a pin for connecting the cam member and the rotary cam follower for respective rotational displacement, said lever being swingable about the hinged connection for rotating the cam member into contact with the cam follower and for correspondingly moving the striker member from a rest position to a stroke position, said striker member being effective for actuating the switch member when in the stroke position.

5. A trigger mechanism as claimed in claim 4 wherein the switch member resiliently urges the striker member to the rest position.

6. A trigger mechanism for a chronograph watch comprising a watchcase having at least one switch member, said switch member being effective for controlling the chronograph functions of the watch, a lever having a pivotal connection to the watchcase, the pivotal connection including a cylindrical cam member and a rotary cam follower, said pivotal connection further including a pivot pin, the cam member and the rotary cam follower being journaled about said pivot pin, said lever being rotationally displaceable about the pivotal connection for rotating the cylindrical cam member into contact with the cam follower, said cam follower including a striker member, said striker member being registrable with the switch member, said striker member being further adapted to actuate the switch member during rotational displacement of the cam follower.

7. A trigger mechanism as claimed in claim 6 wherein the switch member is a spring-urged pushbutton.

8. A trigger mechanism as claimed in claim 6 wherein the rotary cam follower is mounted concentrically with the cylindrical cam member.

9. A trigger mechanism for a watch having a pushbutton operated chronograph function, said pushbutton being urged by a resilient force to an operating position, comprising a striker member registrable with the pushbutton for remotely depressing the pushbutton to actuate a chronograph function, a lever mechanically linked to the striker member by a cam member and a cam follower, said lever being pivotally mounted to the watch and selectively movable for exerting a force on the striker member to displace the striker member from a rest position to a stroke position, said pushbutton being depressed by the striker member when in the stroke position, said striker member being returnable to the rest position by the resilient force acting on the pushbutton.

10. A trigger mechanism as claimed in claim 9 wherein the selective movement of the lever member rotates the cam member into contact with the cam follower and correspondingly displaces the striker member.

11. A trigger mechanism as claimed in claim 9 wherein the striker member extends from the cam follower.

12. A trigger mechanism as claimed in claim 9 wherein the cam member and the cam follower are concentrically mounted for relative rotation with respect to each other.

* * * * *